US008800074B2

(12) United States Patent
Rodgers et al.

(10) Patent No.: US 8,800,074 B2
(45) Date of Patent: Aug. 12, 2014

(54) ADJUSTABLE TOILET LIFT

(75) Inventors: Trafton Rodgers, Lubbock, TX (US); Jahan Rasty, Lubbock, TX (US); Trae Blain, Lubbock, TX (US); Neal St. Martin, Cypress, TX (US); Walter Fagley, Katy, TX (US); Kurt W. Niederer, Charlotte, NC (US)

(73) Assignee: THNK, Inc., Lubbock, TX (US)

( * ) Notice: Subject to any disclaimer, the term of this patent is extended or adjusted under 35 U.S.C. 154(b) by 1501 days.

(21) Appl. No.: 12/093,188

(22) PCT Filed: Nov. 10, 2006
(Under 37 CFR 1.47)

(86) PCT No.: PCT/US2006/060787

§ 371 (c)(1),
(2), (4) Date: Mar. 31, 2010

(87) PCT Pub. No.: WO2007/111701

PCT Pub. Date: Oct. 4, 2007

(65) Prior Publication Data

US 2010/0229293 A1 Sep. 16, 2010

Related U.S. Application Data

(60) Provisional application No. 60/597,133, filed on Nov. 11, 2005.

(51) Int. Cl.
*A47K 13/10* (2006.01)

(52) U.S. Cl.
USPC ..... 4/667; 4/252.1

(58) Field of Classification Search
CPC ..... A61G 7/1007; A47K 13/10; E03D 11/125
USPC ..... 4/252.1–252.6, 667, 420, 645, 436, 408
See application file for complete search history.

(56) References Cited

U.S. PATENT DOCUMENTS

| | | | | |
|---|---|---|---|---|
| 2,345,807 | A * | 4/1944 | Gonzalez et al. | 4/408 |
| 4,174,546 | A * | 11/1979 | Ohtake | 4/420 |
| 4,441,218 | A * | 4/1984 | Trybom | 4/252.2 |
| 4,726,079 | A * | 2/1988 | Signori et al. | 4/420 |
| 5,027,446 | A * | 7/1991 | Robertson | 4/254 |
| 5,090,069 | A * | 2/1992 | Decaux | 4/662 |
| 5,199,113 | A * | 4/1993 | Glasow et al. | 4/252.2 |
| 6,496,989 | B1 * | 12/2002 | Meiser | 4/420 |
| 6,745,417 | B2 * | 6/2004 | Sumino | 4/662 |

* cited by examiner

*Primary Examiner* — Gregory Huson
*Assistant Examiner* — Janie Christiansen
(74) *Attorney, Agent, or Firm* — Oliff PLC

(57) ABSTRACT

An adjustable toilet seat lift adapted to selectively raise and lower a toilet to meet the needs and desires of the user. The lift includes an actuator which adjusts a top plate relative to a bottom plate, and is powered by an external power source, or, in the alternative, manually activated.

14 Claims, 22 Drawing Sheets

ADJUSTABLE TOILET LIFT

BACKGROUND OF THE INVENTION

This invention relates generally to a toilet, and more particularly to a toilet having an adjustable height to facilitate use by individuals with physical limitations.

Individuals who live with a physical impairment often have difficulty performing simple, everyday tasks. Some of these tasks are imperative for everyday living, such as using a toilet. Typically, a standard toilet is permanently affixed to a drain with a wax seal and is not intended to be moved, and the height of the toilet is at a predetermined standard height and cannot be adjusted. Most standard toilets are either too high or too low for a person with a physical impairment to safely use. In addition, for someone confined to a wheelchair, the height of a wheelchair is usually not level with the toilet seat, causing a difficult task to become even more complicated.

To partially rectify this problem, is known to provide an attachment to increase the height of the toilet. This attachment either is attached to the toilet bowl or is a free standing device that sits over the toilet bowl, but is not adjustable by a user during use. These attachments are adequate for individuals who merely require a preset, raised toilet seat; however, for other individuals with physical limitations, this is not a viable option.

SUMMARY OF THE INVENTION

Therefore, it is an object of the invention to provide an adjustable height toilet or toilet lift which is safe and easy to use.

It is another object of the invention to provide a lift that can be easily adjusted by the user before, during, and after use.

It is another object of the invention to provide an elevation system that uses water line pressure to perform the lifting function.

It is another object of the invention to conserve water by using the same volume of water for a lifting function also for flushing a toilet.

These and other objects are met by the present invention, which according to one embodiment provides a toilet lift for adjusting the height of a toilet, including: (a) a base plate for being attached to a floor, the base plate having a lower bore therethrough; (b) a top plate disposed over the base plate, the top plate adapted to carry a toilet thereupon, and having an upper bore therethrough; (c) a lifting mechanism disposed between the base plate and the top plate, the lifting mechanism operable to move the top plate from a lowered position adjacent the base plate to a raised position spaced-away from the base plate; and (d) a drain extension conduit connected to the first and second bores, the drain extension conduit arranged to allow discharge from the toilet to pass from the upper bore to the lower bore regardless of the position of the top plate.

According to another embodiment of the invention, the lifting mechanism includes a plurality of variable-length actuators disposed between the base plate and the top plate.

According to another embodiment of the invention, the lifting mechanism includes at least once scissor frame jack disposed between the base plate and the top plate.

According to another embodiment of the invention, the lifting mechanism comprises: (a) a first rod with its upper end pivotally connected to the top plate and its lower end disposed in rolling contact with the base plate; (b) a second rod with its lower end pivotally connected to the top plate, its lower end disposed in rolling contact with the top plate, and its central portion pivotally connected to the first rod; and (c) an actuator connected to the base plate and the lower end of the first rod and operable to move the first rod along a generally horizontal axis so as to cause the first and second rods to lift or lower the top plate.

According to another embodiment of the invention, the base plate includes at least one side portion which hides the lifting mechanism from view.

According to another embodiment of the invention, the toilet lift further includes a motion sensor operable to determine the presence of a user and to cause the lifting mechanism to raise the toilet to a predetermined height in response thereto.

According to another embodiment of the invention, the toilet lift further including a toilet having a bowl and a base plate, wherein the base plate is integral with the top plate.

According to another embodiment of the invention an adjustable height toilet includes: (a) a toilet base for being attached to a floor; (b) a toilet housing carried by the base and moveable up and down relative thereto, the toilet housing including: (i) a tank housing including a water tank; (ii) a toilet bowl; and (iii) a flushing mechanism; (c) at least one fluid lifting cylinder disposed between the base plate and the toilet housing, the lifting mechanism operable to move the toilet housing from a lowered position adjacent the toilet base to a raised position spaced-away from the toilet base; and (d) a drainage pipe assembly connected to the toilet housing, the drainage pipe assembly arranged to allow discharge from the toilet bowl to pass from the toilet housing to the toilet base regardless of the position of the toilet housing.

According to another embodiment of the invention, the lifting cylinder is integrally-formed with the toilet housing.

According to another embodiment of the invention, the toilet housing is received between a pair of opposed side panels extending upwardly from the toilet base.

According to another embodiment of the invention, the drainage pipe assembly includes a plurality of concentric pipe segments, the diameter of the segments decreasing from a bottom to a top of the drainage pipe assembly.

According to another embodiment of the invention, each of the pipe segments includes an outwardly-extending flange at its lower end and a resilient ring at its upper end.

According to another embodiment of the invention, the adjustable height toilet further includes a lift valve operable to selectively connect the lifting cylinder to: (a) a supply of pressurized fluid, so as to raise the toilet housing; or (b) a drain path to allow fluid to drain from the lifting cylinder, so as to lower the toilet housing.

According to another embodiment of the invention, the drain path from the lifting cylinder is arranged to discharge into the water tank.

According to another embodiment of the invention the adjustable height toilet further includes: (a) a lid mounted to the toilet bowl and moveable between open and closed positions; and (b) a drain valve operably connected to the lid such that: (i) when the lid is in the open position, the drain valve is closed; and (ii) when the lid is in the closed position, the drain valve connects the lifting cylinder to a drain path to allow fluid to drain from the lifting cylinder, so as to lower the toilet housing.

According to another embodiment of the invention, the adjustable height toilet further includes: (a) a lid mounted to the toilet bowl and moveable between open and closed positions; and (b) a linkage operably connected to the lid such that the flushing mechanism is triggered when the lid is moved to the closed position.

According to another embodiment of the invention, the adjustable height toilet further includes: left and right side rails mounted to the toilet housing, the side rails individually moveable between a lowered use position and a raised position.

According to another embodiment of the invention, the lateral position of each of the side rails is adjustable so as to vary the width between the side rails.

According to another embodiment of the invention, a preselected volume of water required to raise the toilet housing from the lowered position to the raised position is substantially equal to a preselected volume of water stored in the water tank to flush the toilet bowl.

According to another embodiment of the invention, the adjustable height toilet further includes an adjustable stop carried by the toilet housing for preventing motion of the toilet bowl below a preselected lower limit.

According to another embodiment of the invention, the adjustable height toilet of further includes an adjustable stop carried by the toilet housing for preventing motion of the toilet bowl above a preselected upper limit.

BRIEF DESCRIPTION OF THE DRAWINGS

The invention may be best understood by reference to the following description taken in conjunction with the accompanying drawing figures, in which.

DESCRIPTION OF THE PREFERRED EMBODIMENT AND BEST MODE

Figure 1:
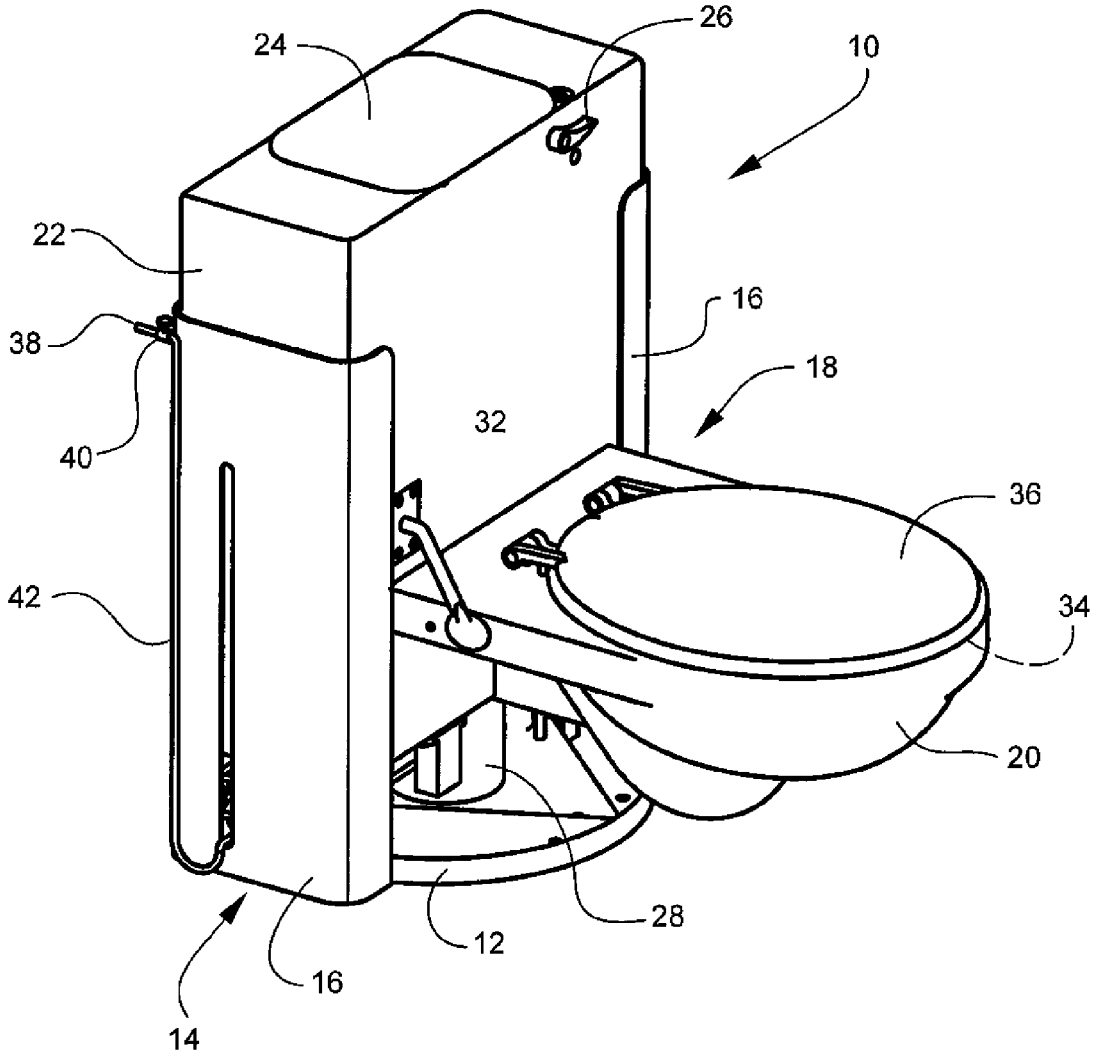
FIG. 1 is a perspective view of an adjustable toilet constructed according to an aspect of the invention, in a lowered position.
Figure 2:
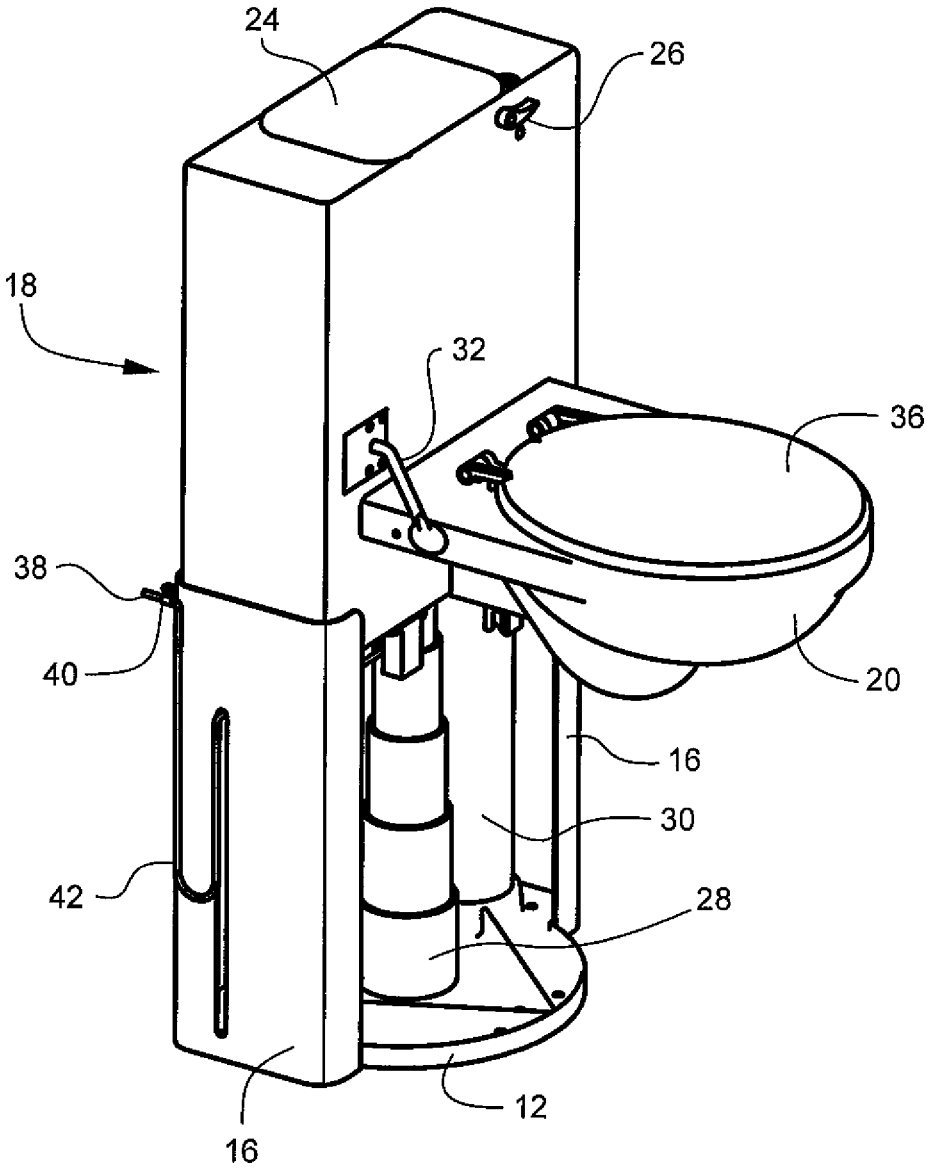
FIG. 2 is a perspective view of the adjustable toilet of FIG. 1 in a raised position.

Referring now specifically to the drawings, an exemplary adjustable toilet constructed according to an aspect of the invention is illustrated in FIGS. 1 and 2 and is shown generally at reference numeral 10. A toilet base 12 is fastened to the a floor (not shown) and includes an upwardly-extending skirt 14 constructed of a pair of opposed, generally C-shaped panels 16. The toilet base 12 carries a toilet housing 18 which includes a toilet bowl 20 and a tank housing 22. The tank housing 22 is received in and located by the skirt 14 between the panels 16 such that it can move freely up and down. The tank housing 22 includes a water tank 23 (visible in FIG. 14), a tank cover 24 on top, and a flush handle 26 for manual flush initiation. The complete toilet housing 18 can be moved between a lowered position (FIG. 1), and a raised position (FIG. 2). A collapsible drainage pipe assembly 28 interconnects the toilet housing 18 and the toilet base 12. One or more lifting cylinders 30 are pressurized by a fluid as described below to raise the toilet housing 18, and gravitational force is used to exhaust the liquid from the lifting cylinders 30. Two lifting cylinders 30 each of about 10 cm (4 in.) diameter may be used for lifting of the toilet bowl 20 through a total stroke of about 38 cm (15 in.). Other types of lifting devices, such as pneumatic cylinders or mechanical actuators, may be substituted for the lifting cylinders 30 if desired.

A height adjustment lever 32 is also incorporated into the tank housing 22 and serves as the control for raising or lowering the toilet housing 18. A seat 34 and lid 36 are mounted on top of the toilet bowl 20. A water supply is fed to the adjustable toilet 10 through a wall outlet 38, for example using a shut-off valve 40 feeding a flexible connector hose 42.

Figure 3:
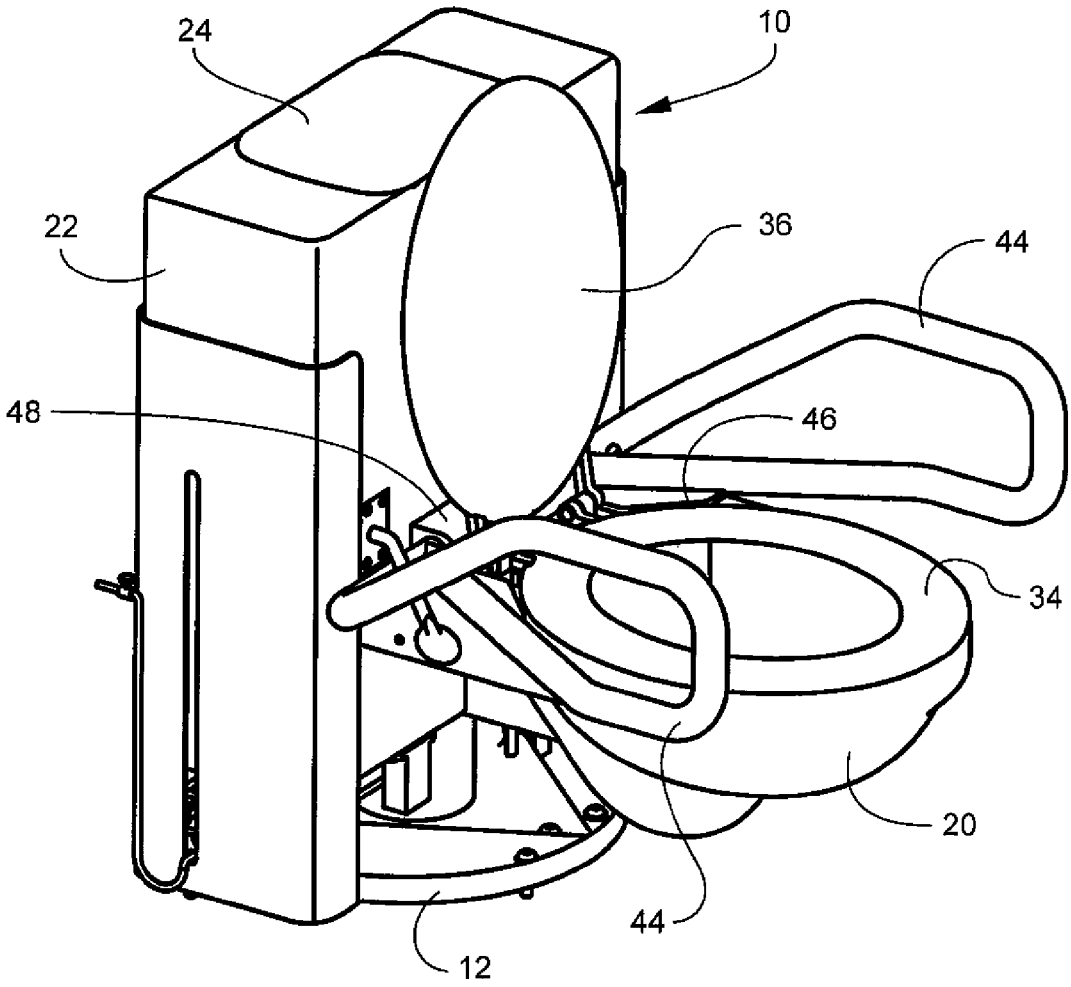
FIG. 3 is a perspective view of the adjustable toilet of FIG. 1 with side rails mounted thereto.
Figure 4:
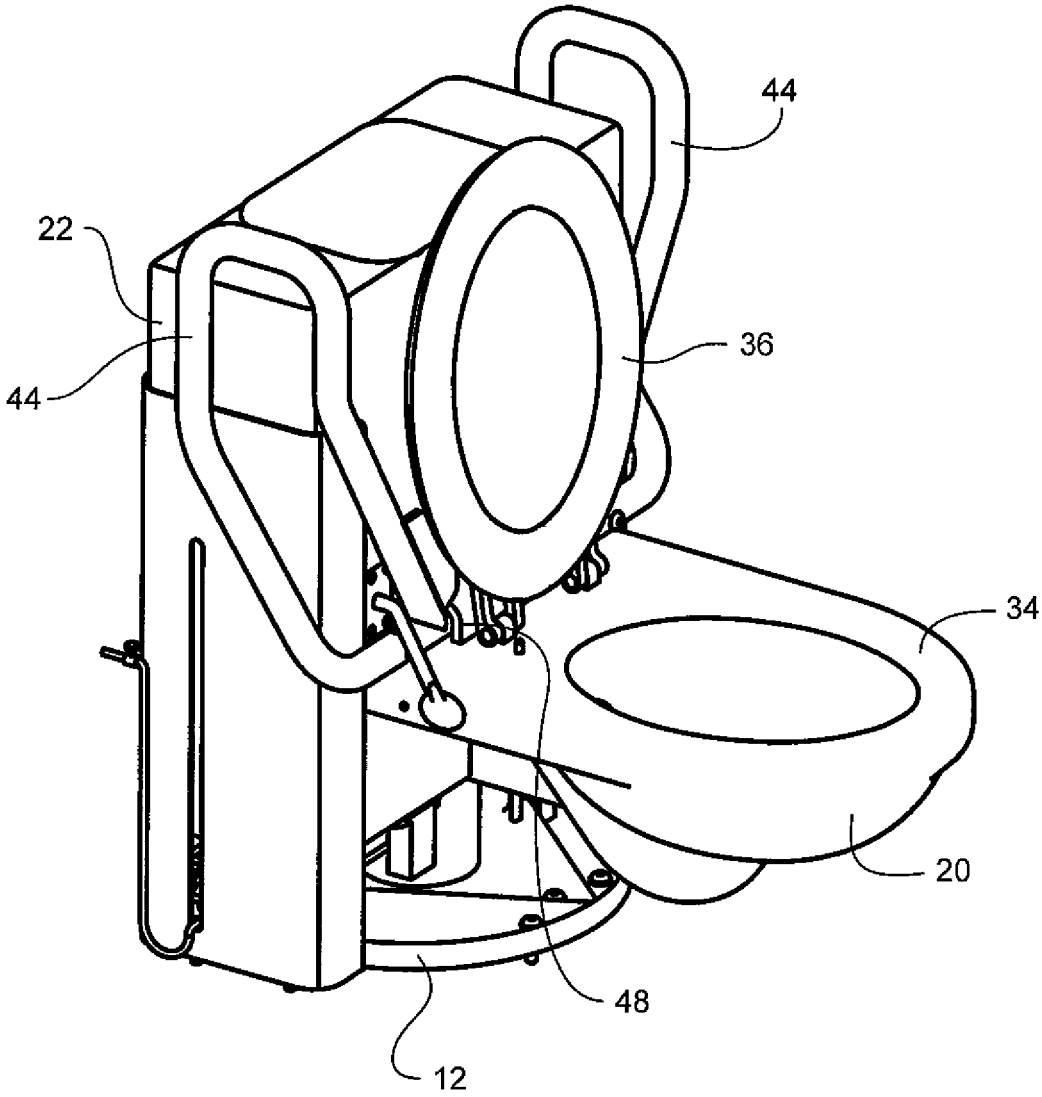
FIG. 4 is a perspective view of the adjustable toilet of FIG. 3 with the side rails in raised position.

Optionally, the adjustable toilet 10 may be equipped with side rails for supporting a user. In FIG. 3, these side rails 44 are shown in a lowered or operating position. The side rails 44 bear on the toilet bowl 20 with attached rail plates 46. In FIG. 4, the side rails 44 are shown in a raised or retracted position. The side rails 44 are pivotally mounted in a rail pivot block 48, which in turn is mounted onto the toilet housing 18.

Figure 5:
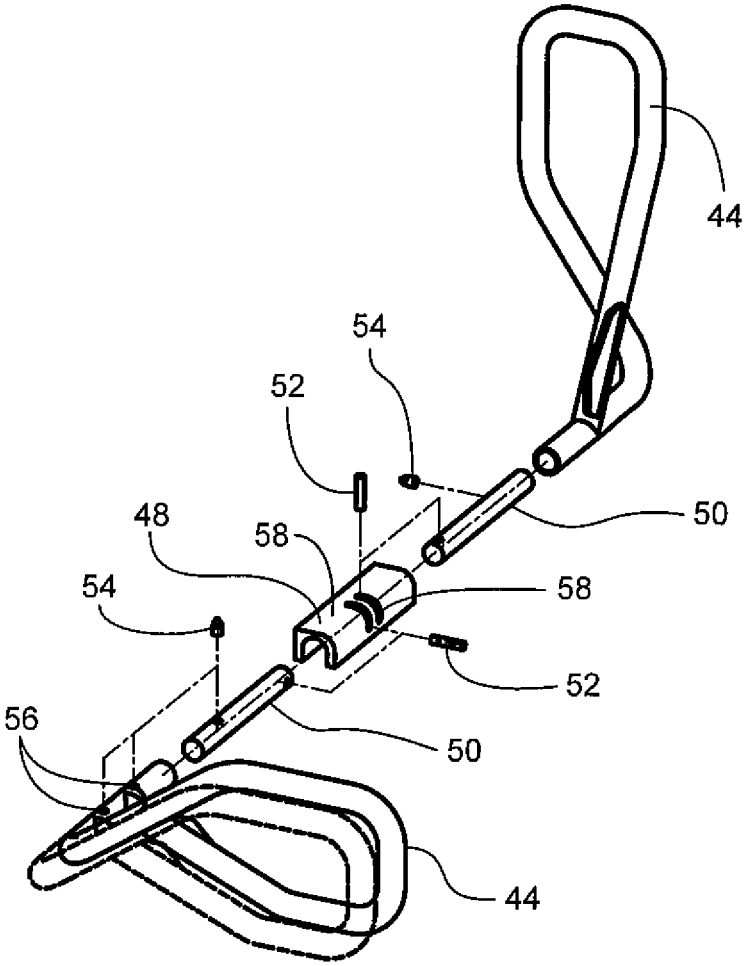
FIG. 5 shows in perspective view the parts used for the width adjustment of the side rails.

FIG. 5 is an exploded view of the side rails 44, a pair of rail pivot shafts 50, the rail pivot block 48 and centering pins 52. Centerlines indicate how the different parts are fitted together. Each side rail 44 can be raised or lowered independently by pivoting with its rail pivot shaft 50, and can be slid inward or outward along its rail pivot shaft 50, to facilitate mounting and dismounting of the toilet 10. Spring-loaded ball plungers 54 mounted in the rail pivot shafts 50 serve to lock the side rails 44 to the desired width, in cooperation with holes 56 in the side rails 44. It is understood that other common fastening methods can be used for permanent or temporary locking the side rails 44 onto rail pivot shafts 50. A slot 58 in the pivot block 48 receives the centering pins 52 to assure that the side rails 44 are held in place in the pivot block 48.

Figure 6:
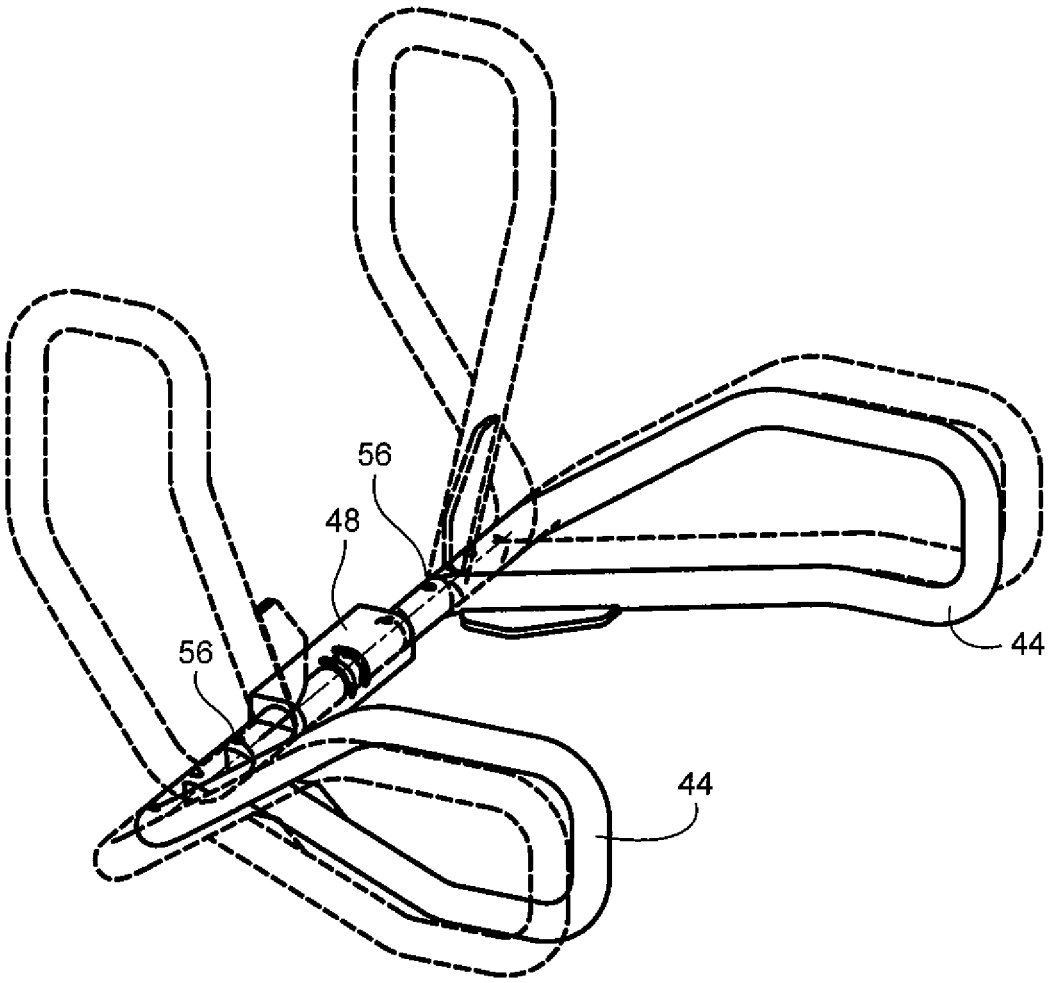
FIG. 6 shows in perspective view how the side rails are adjusted for different widths.

FIG. 6 shows how the parts as shown in FIG. 5 are fitted together and how selecting the appropriate holes 56 in the side rails 44. The dotted lines show the outermost positions of the side rails 44 as well as their up- or down positioning.

Figure 7:
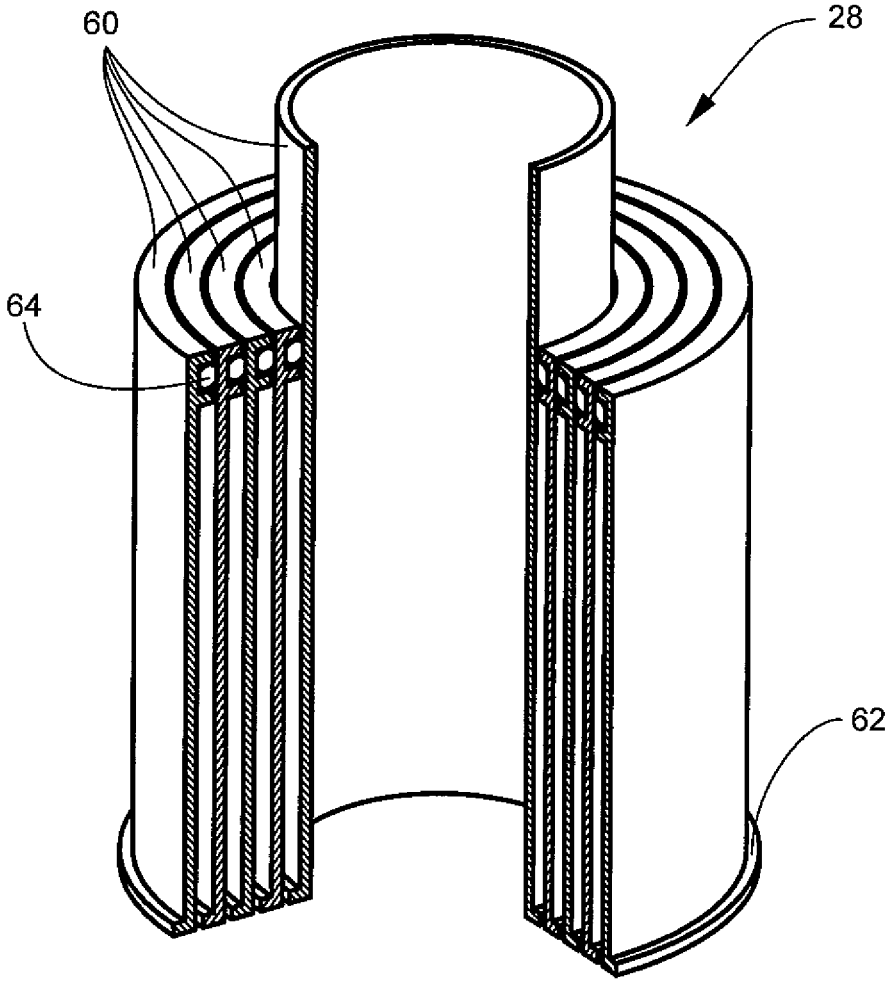
FIG. 7 is a cutaway, perspective view of a collapsible drainage pipe of the adjustable toilet in its fully collapsed state.
Figure 8:
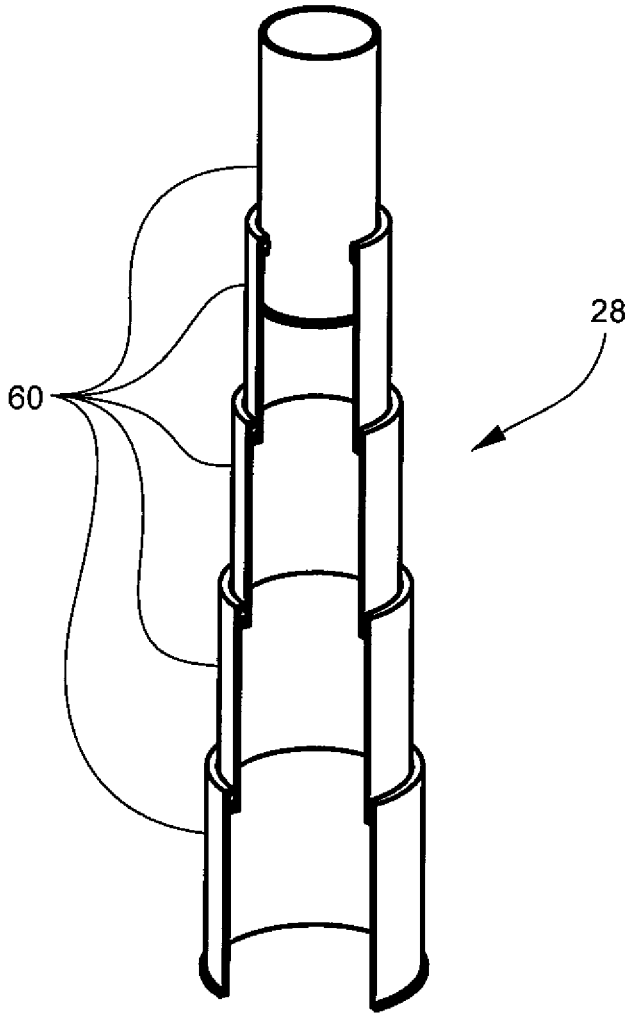
FIG. 8 is a cutaway, perspective view of the drainage pipe of FIG. 12 in an extended position.

FIGS. 7 and 8 illustrate the drainage pipe assembly 28 in more detail. The drainage pipe assembly 28 is made up from several closely-fitted concentric pipe segments 60, with their diameter decreasing from the bottom of the assembly 28 to its top. Each pipe segment 60 has an outwardly-extending flange 62 at its lower end and a resilient ring 64 at its upper end to provide a seal against leakage of waste, odor and liquid. In FIG. 7 the drainage pipe assembly 28 is collapsed as is the case with the toilet bowl 20 in its lowest position. In FIG. 8 the drainage pipe assembly 28 is extended as is the case with the toilet bowl 20 in its highest position. The ever increasing diameter from the top to the bottom prevents the drainage pipe assembly 28 from presenting a "shelf" which could collect waste. The lowering and raising of the toilet bowl 20 will have a scrubbing action on the sidewalls of the drainage pipe assembly 28 and drop the scrubbed off particles effectively down a drainage hole in the floor.

Figure 22:
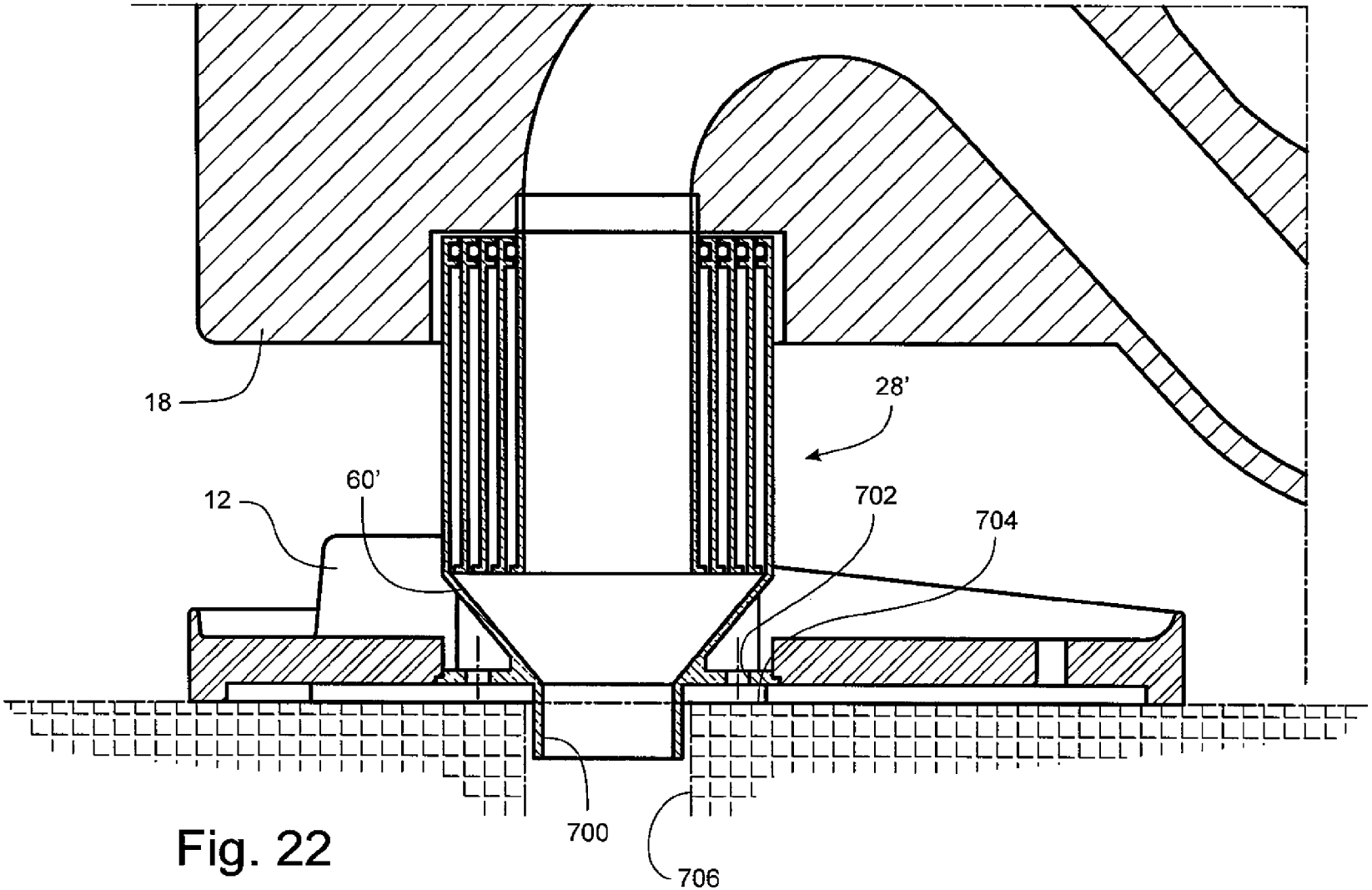
FIG. 22 is a cross-sectional view through the adjustable toilet, showing how it may be mounted to a floor.

As shown in FIG. 22, the toilet base 12 may be provided with a pipe stub or "horn" 700 and mounting bolt holes 702 which allow it to be mounted to a standard plumbing toilet flange 704 and drain pipe 706. To accommodate this mounting, an alternative drain pipe assembly 28' may be used which has a tapered bottom pipe segment 60' to make a smooth transition to the diameter of the horn 700.

Figure 9:
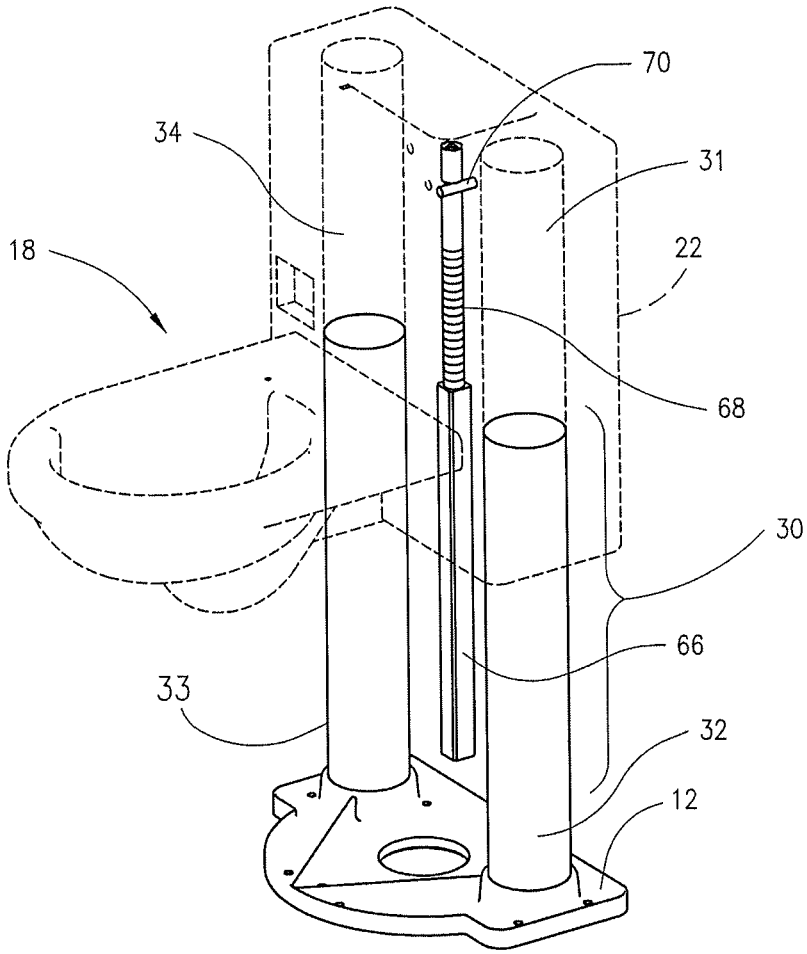
FIG. 9 shows in perspective view how the height of the bottom position of the toilet can be adjusted.
Figure 10:
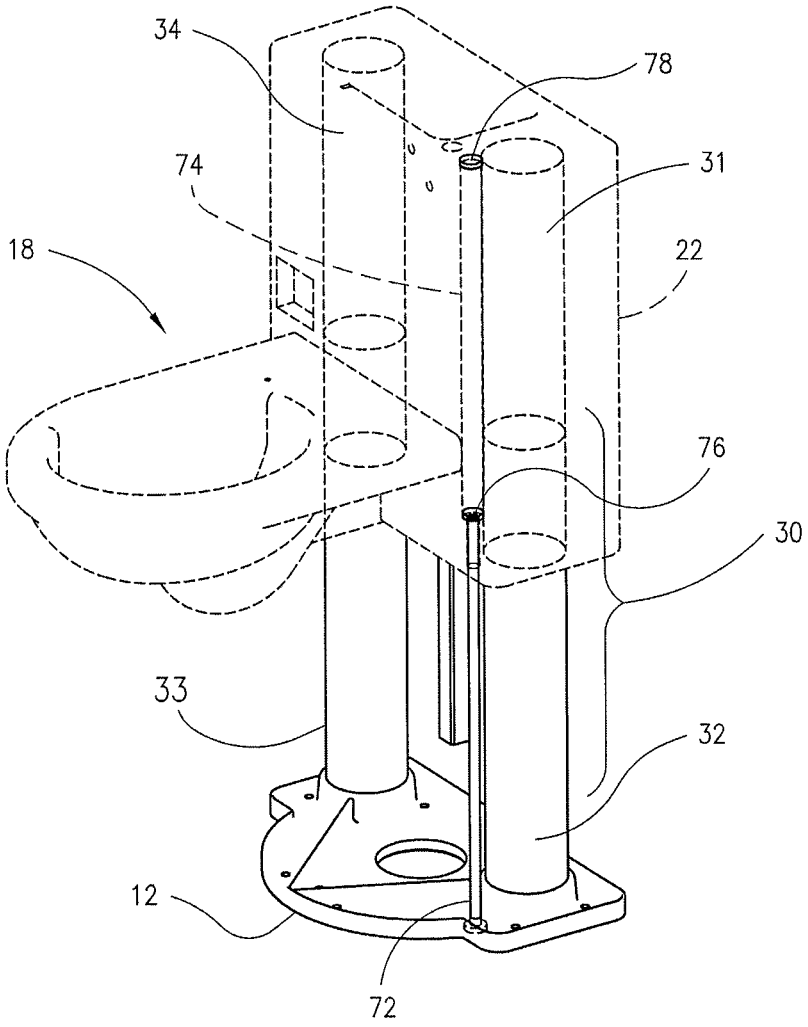
FIG. 10 shows in perspective view how the height of the top position of the toilet can be adjusted.

FIG. 9 shows how the bottom position of the toilet housing 18 can be adjusted. An internally-threaded, square-section bottom stop bar 66 and a stop screw 68 are mounted in the tank housing 22. The bottom stop bar 66 can slide in a vertical direction in the tank housing 22. The rotatable stop screw 68 the bottom stop bar 66 is moved up or down. The bottom stop bar 66 will contact the toilet base 12 in the desired portion and stop any further lowering of the toilet housing 18. FIGS. 9 and 10 further show the first and second fluid lifting cylinders 30, wherein the first fluid lifting cylinder has a first rigid cylinder portion 31 and a second rigid cylinder portion 32 and the second fluid lifting cylinder has a first rigid cylinder portion 33 and a second rigid cylinder portion 34.

FIG. 10 illustrates how the upward stroke of the toilet housing 18 may be stopped. A top stop bar 72 is firmly held in the toilet base 12 and extends into a hole 74 in the tank housing 22. The top stop bar 72 has an enlarged top end 76 (larger than a reduced-diameter bottom flange of the hole 74) which interferes with further upwards motion once it contacts the bottom flange. The length of the top stop bar 72 may be adjustable. A plug 78 covers the hole 74 on top.

Figure 11:
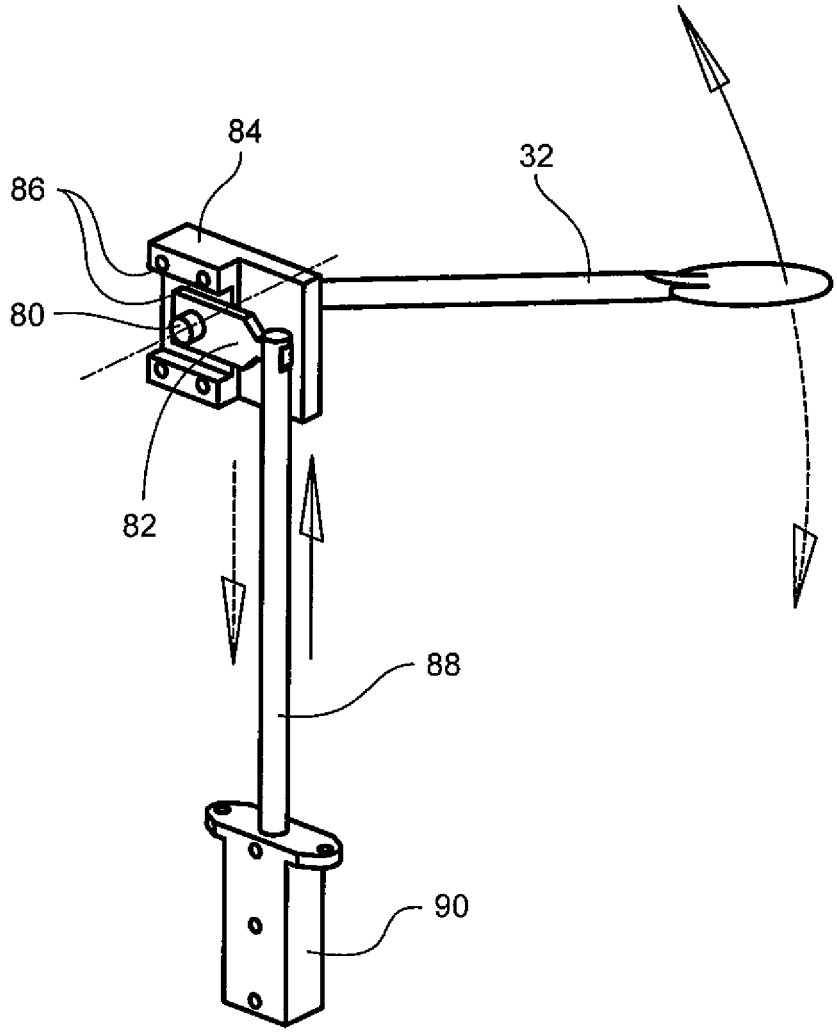
FIG. 11 is a perspective view of parts used for the adjustment of the toilet height.

FIG. 11 shows in perspective view the control linkage for raising and lowering the toilet bowl 20. It includes the height adjustment lever 32 with pivot shaft 80 and extension lever 82 connected thereto. A pivot plate 84 is mounted on the tank housing 22 using mounting holes 86 and allows the height adjustment lever 32 to pivot. An actuating rod 88 of a lift valve 90 is connected to the extension lever 82. Moving the height adjustment lever 32 up or down moves the actuating rod 88 into or out of the lift valve 90. In this example, the lift valve 90 is a 3-way valve of the 3-position, manually operated, spring-centered type.

Figure 12:
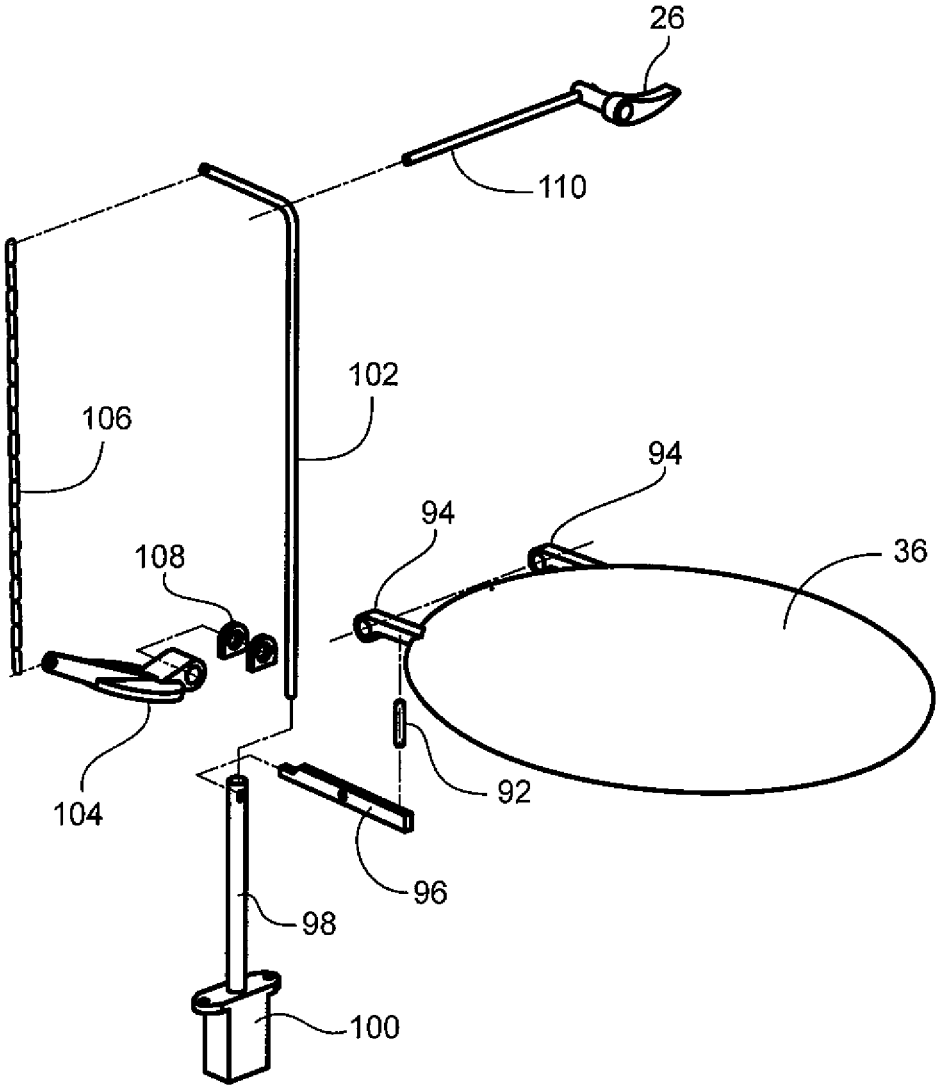
FIG. 12 is an exploded view of the parts used for the automatic flushing and lowering of the toilet to its lowered position.
Figure 13:
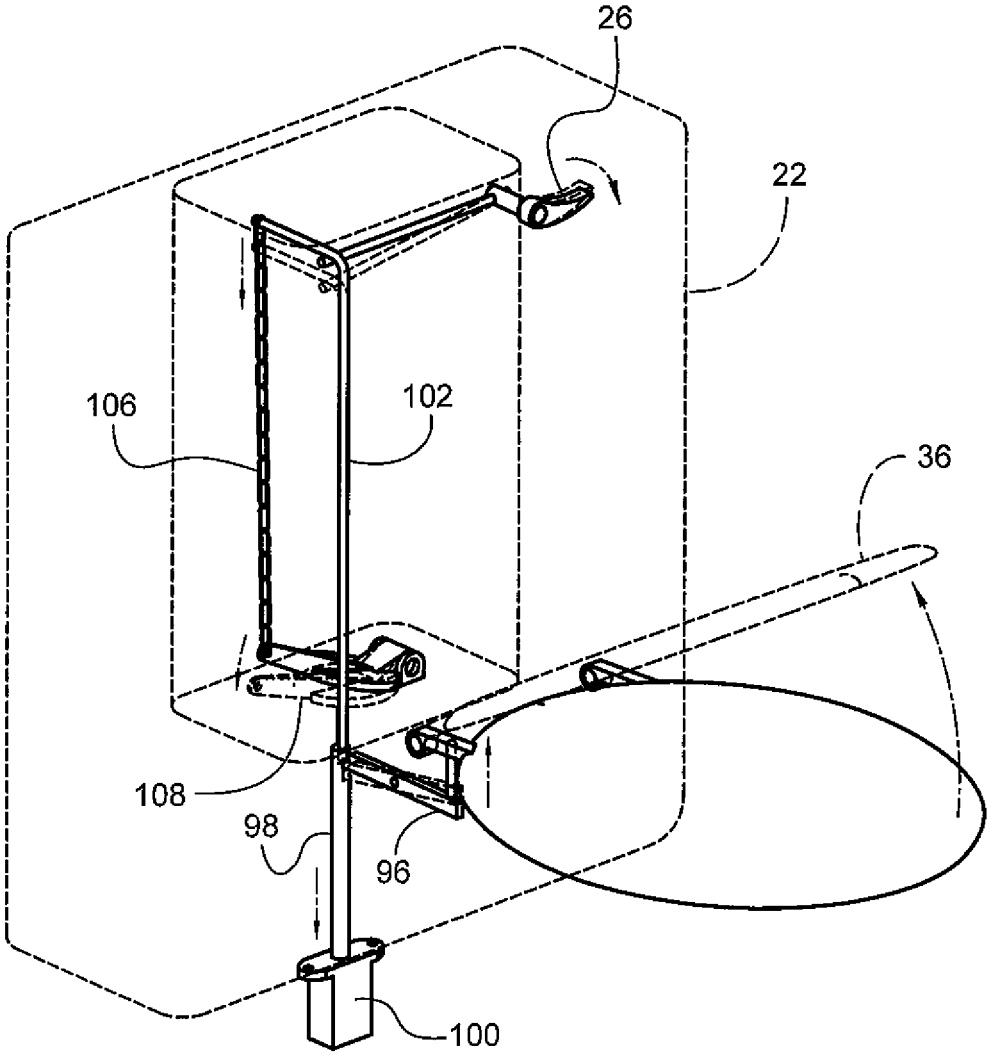
FIG. 13 is a perspective view of the parts used for the automatic flushing and lowering of the toilet to its lowered position.

FIGS. 12 and 13 show in perspective view components used for automatic resetting of the toilet height adjustment and simultaneous automatic flushing. An automatic resetting pin 92 is positioned under one of the mounts 94 of the lid 36, and is connected to the front end of a pivot link 96, the rear end of which is connected to the actuating rod 98 of a drain valve 100. In this example, the drain valve 100 is a normally-closed, manually-operated and spring-biased 2-way valve. The rear end of the pivot link 96 is connected an upright flushing rod 102 which in turn is connected to a conventional flapper valve 104 by a flapper chain 106. The flapper valve 104 is pivotally held by a flapper pivot 108. The flush handle 26 is pivotally mounted to the 22 and connected to the flush rod 102 by a lever extension 110.

The flushing rod 102 includes means for allowing the flapper valve 104 to return to a closed position after the flush cycle is completed. In the example illustrated in FIGS. 21A-21C, the flushing rod 102 comprises an upper portion 102A received inside a tubular lower portion 102B. The upper portion 102A carries a laterally-moveable spring latch 102C at its lower end. The flushing rod 102 is carried in a vertical hole or channel 103 in the tank housing 22 which includes a tapered section 103A connecting a lower section 103B and a narrower upper section 103C.

Figure 14:
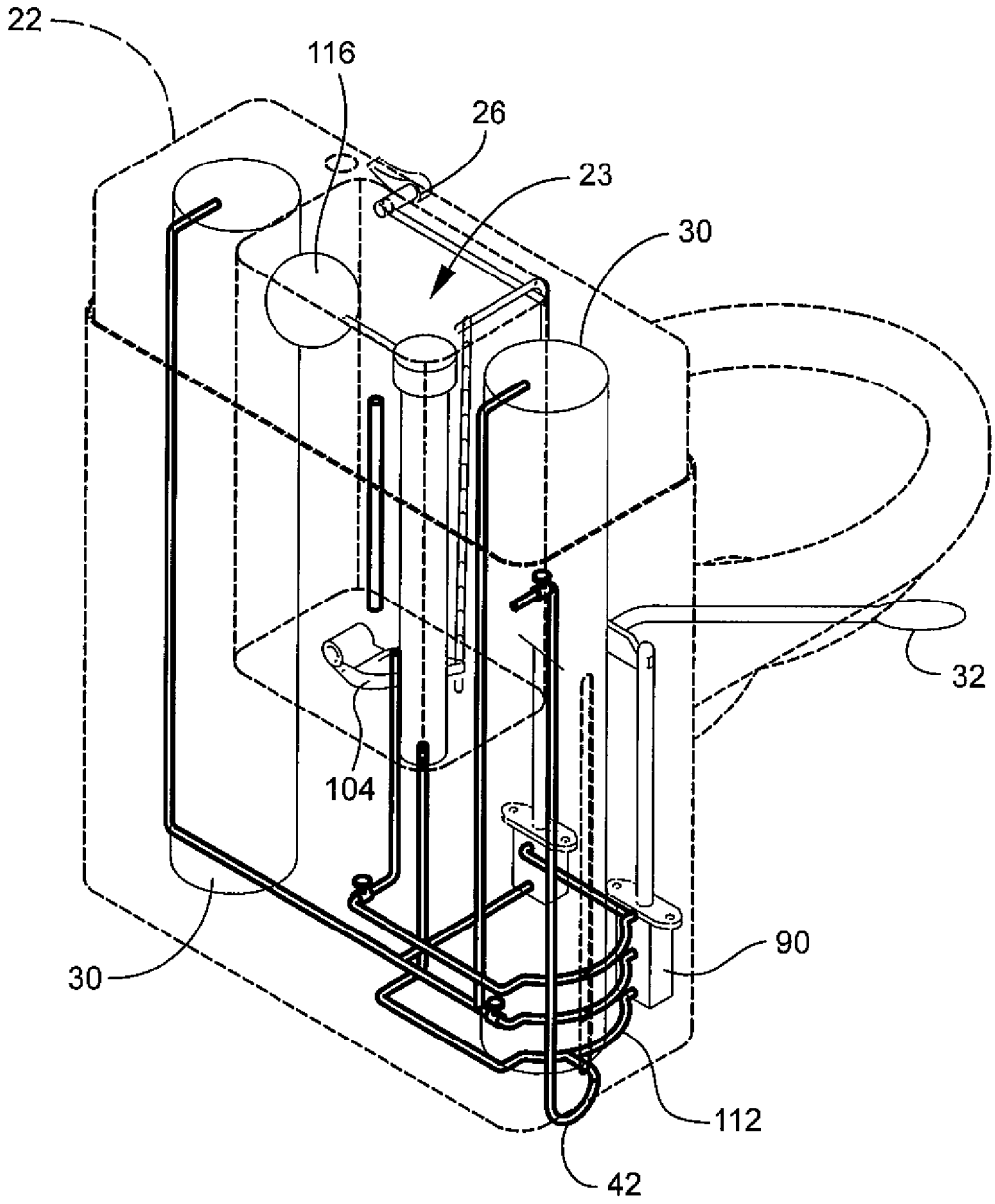
FIG. 14 is a perspective view the fluid piping of the adjustable toilet.
Figure 15:
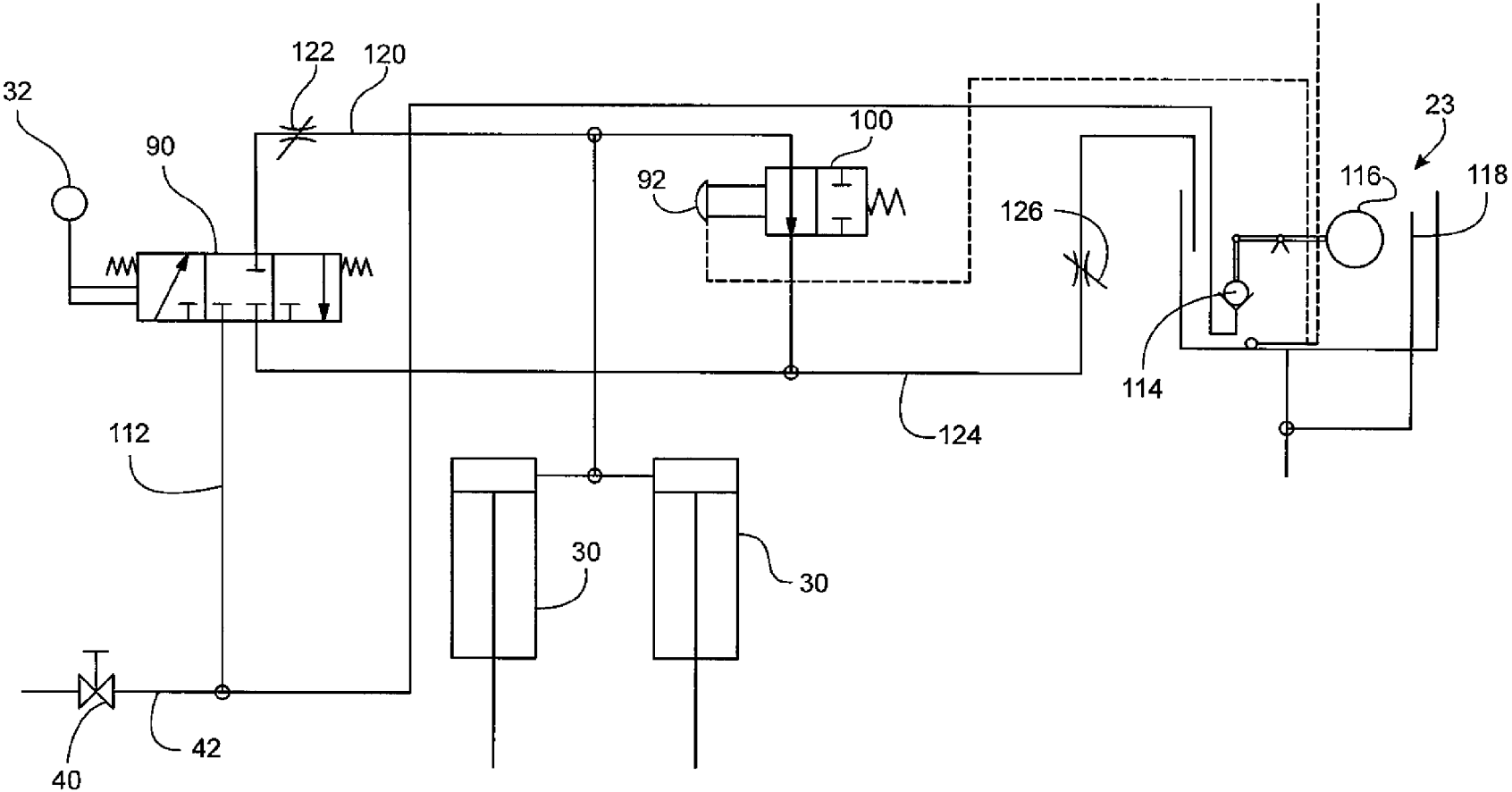
FIG. 15 is a fluidic diagram for the adjustable toilet.

FIGS. 14 and 15 illustrate the structure of the raising and lowering system of the adjustable toilet 10. Fluid (typically domestic water supply) enters the system from wall outlet 38 through the shut-off valve 40. It is piped through the flexible connector hose 42 and valve supply pipe 112 to the lift valve 90. It also flows through the valve supply pipe 112 to a standard filler valve 114, which is operated by a float 116 in the water tank 23. An overflow tube 118 of a standard type has one end disposed in the water tank 23. The water tank 23 may be an integral part of the tank housing 22.

A cylinder supply line 120 extends between the lift valve 90 and the lifting cylinders 30, and may include a raising throttle 122 therein (e.g. a fixed or variable orifice) for controlling the speed of the raising motion. As shown, the lifting cylinders 30 may also be integrally-formed with the tank housing 22. A recycling line 124 connects to lift valve 90 to the water tank 23. A lowering throttle 126 in the recycling line 124, similar to the raising throttle 122, enables control the descending speed of the toilet bowl 20. The drain valve 100 is connected to the lift valve 90 on one side and to the cylinder supply line 120 on the other side to enable automatic resetting of the toilet bowl 20 when the lid 36 is closed.

Manual lifting and lowering of the toilet housing 18 operates as follows. To raise the toilet housing 18, the height adjustment lever 32 is raised, causing pressurized water to flow into the lifting cylinders 30. To lower the toilet housing 18, the height adjustment lever 32 is lowered, allowing water to be forced out of the lifting cylinders 30 and through the recycling line 124 into the water tank 23. To the extent that raising and lowering the toilet housing 18 without flushing causes the water tank 23 to approach an overfilled condition, the excess water drains through the overflow tube 118.

If desired, the adjustable toilet 10 may be flushed by pushing the flush handle 26 down in a clockwise motion. This raises the lever extension 110 which is positioned under the flushing rod 102. This motion will cause the flapper chain 106 to open the flapper valve 104 in order to flush the toilet, in a conventional manner.

The automatic resetting of the toilet height adjustment and simultaneous automatic flushing features operates as follows. Lowering the lid 36 will depress the automatic resetting pin 92, which in turn rotates pivot link 96 clockwise. This will raise the actuating rod 98 of the drain valve 100, opening the drain valve 100 to release the liquid out of the lifting cylinders 30 through the recycling line 124, and allowing the toilet housing 25 to lower to its bottom position.

Figures 21A, 21B, 21C:
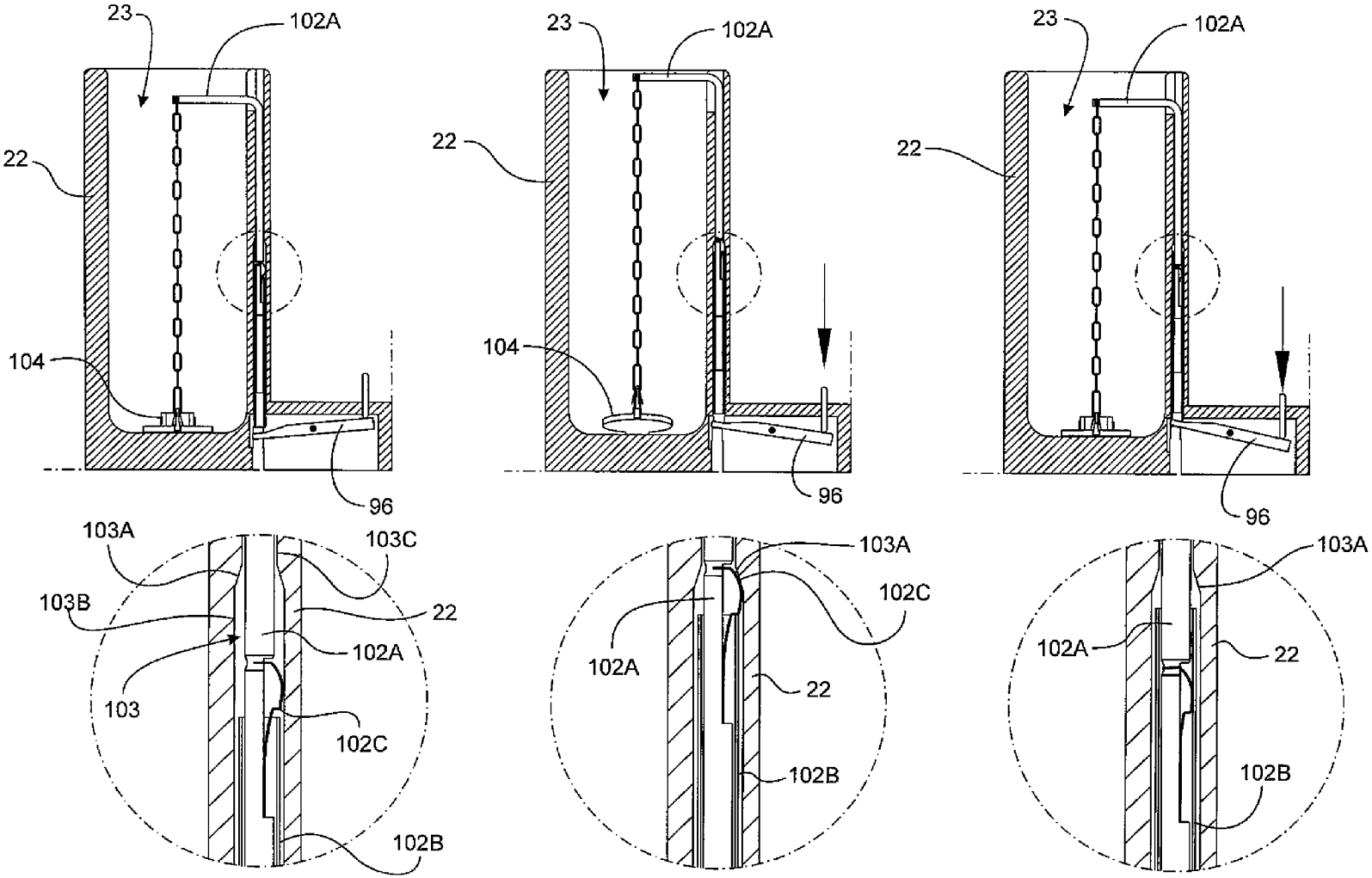
FIGS. 21A through 21C are sequential cross-sectional views of a tank housing of the present invention, showing an automatic flushing mechanism in different positions.

Simultaneously, the pivot link 96 lifts the flushing rod 102 and flapper chain 106, opening the flapper valve 104 to initiate a flush cycle. When the flushing rod 102 is initially raised (FIG. 21A), the spring latch 102C maintains the upper and lower portions 102A and 102B extended at their full length. As the flushing rod 102 is raised further, the spring catch 102C is depressed by contact with the tapered section 103A of the channel 103, shown in FIG. 21B, allowing the upper portion 102A to collapse into the lower portion 102B, as shown in FIG. 21C. This allows the flapper valve 104 to close normally. When the pivot link 96 is lowered again, the flushing rod 102 extends to its full length and the spring latch 102C resets. Thus, the act of closing the lid 36 both empties the toilet 10 and resets its height for the next user. The space vacated in the water tank 23 as the flush cycle occurs provides room to receive the water drained from the lifting cylinders 30. The automatic lowering feature and/or the automatic flushing feature may be implemented together as described herein, separately, or not at all.

The amount of water to be used for a full lift of about 38 cm (15 inches) is about 6 liters (1.6 gallons). This amount of fluid is released into the water tank 23 and will be used for the next flushing. In this manner, the water for the lifting action is not wasted (i.e. drained through the overflow tube 118) but is preserved, and is the same amount as is legally required at this time to be the maximum to be used for one flushing. It is also noted that the use of two lifting cylinders 30 of approximately 10 cm (4 in.) diameter results in a total lifting force of about 227 kg (500 lbs.) at a nominal water pressure of about (20 psi). In the unlikely case that the line water pressure does not suffice, a booster pump of known type can be inserted between the water line and the system of the adjustable toilet.

Figure 16:
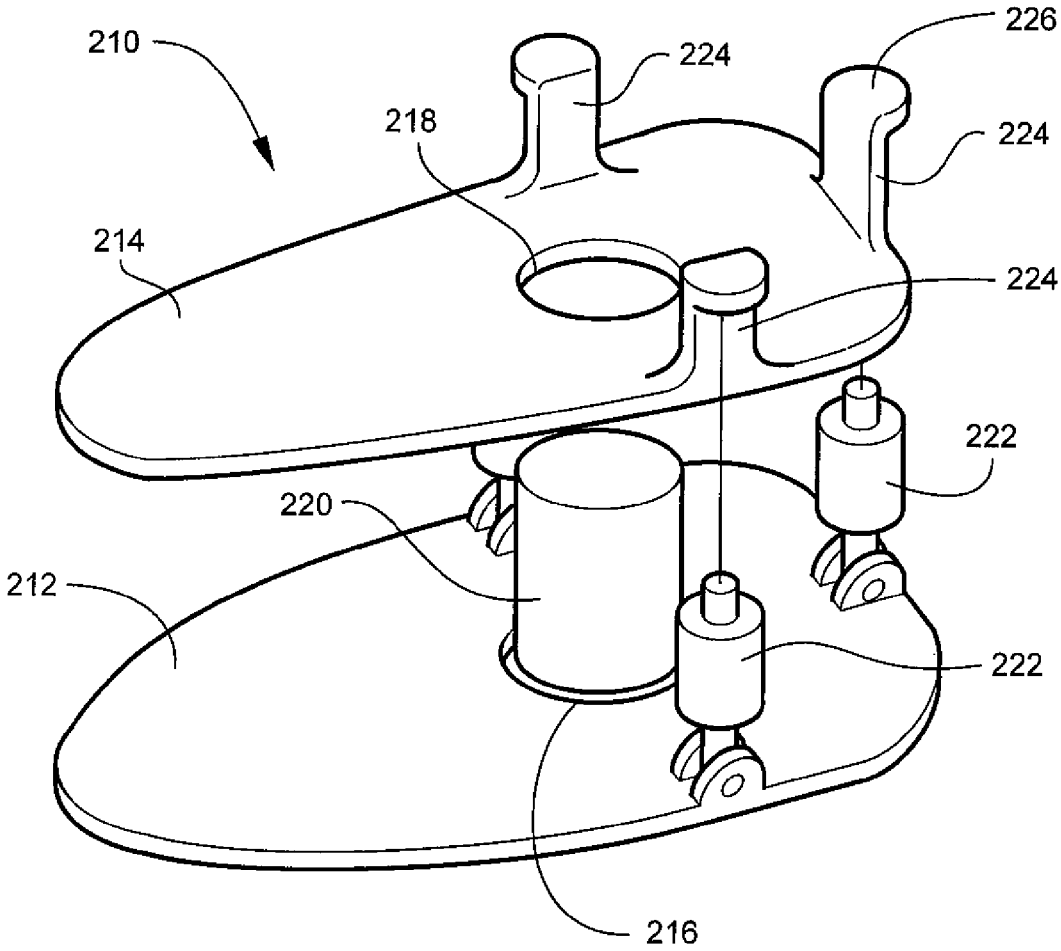
FIG. 16 is a perspective view of an adjustable toilet lift constructed according to an aspect of the invention.

Alternatively, a separate toilet lift may be provided which can be used with an existing toilet. A exemplary adjustable toilet lift is illustrated in FIG. 16 and is shown generally at reference numeral 210. The toilet lift 210 includes a base plate 212 and a top plate 214, and one or more actuators 222 for moving the top plate 214 relative to the base plate 212, which are pivotally connected hydraulic jacks in the illustrated example. The top plate 214, which carries a standard toilet (not shown), includes three flange members 224 extending upward and having horizontal members 226 at the upper ends thereof, which engage the actuators 222.

Two aligned bores 216, 218 are positioned within the bottom plate 212 and top plate 214, respectively, to allow discharge from the toilet to pass through the lift 10 by way of a drain extension 220. The bore 216 of the base plate 212 is connected to the drain opening in the floor, and the bore 218 of the top plate 214 is connected to the drain outlet of the toilet. An external power source (not shown) such as a hydraulic pump is employed to selectively raise and lower the actuators 222.

Figure 17:
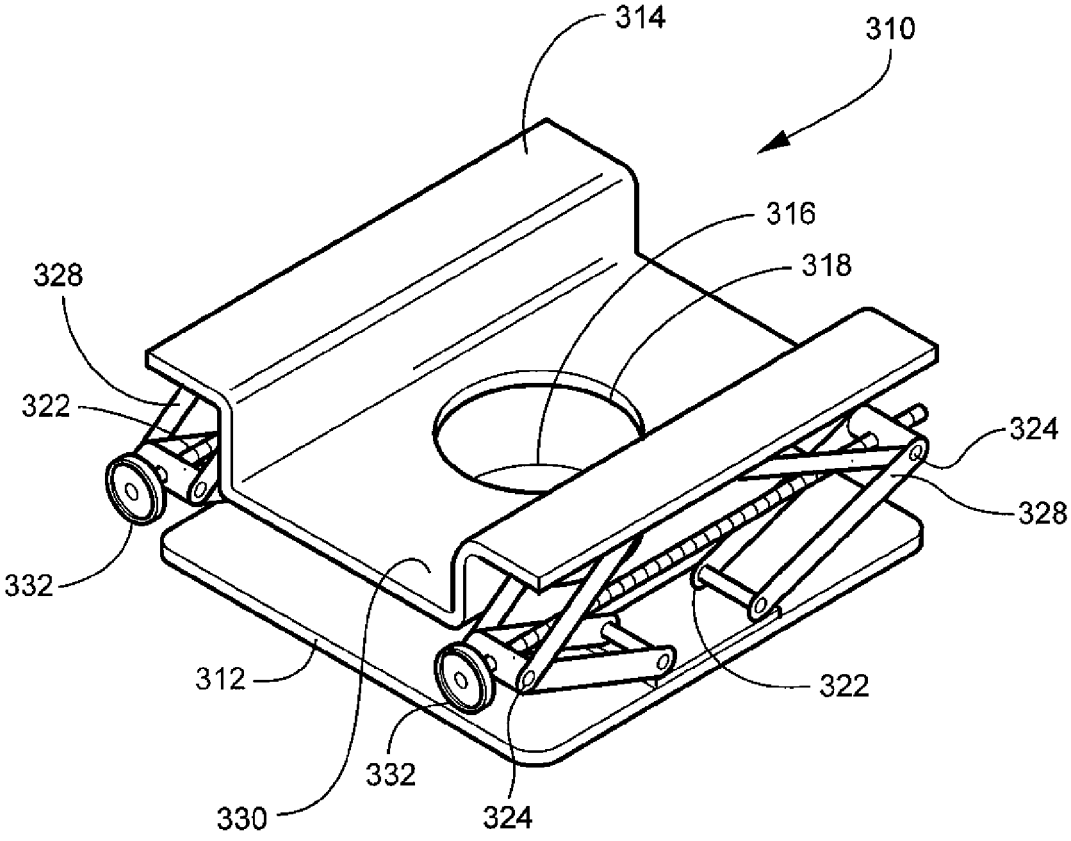
FIG. 17 is a perspective view of an alternative adjustable toilet lift.

FIG. 17 shows an alternative lift 310 in which the actuator comprises one or more scissor frame jacks 328 positioned between a base plate 312 and a top plate 314. The jacks 328 each include a threaded screw 322 extending laterally therethrough with an optional turning knob 332 positioned on one end. As the screw 322 is turned in one direction, frame hinges 324 move along the threads of the screw 322 toward each other, causing the jacks 328 to extend upward. When the screw 322 is turned in the opposite direction, the frame hinges 324 move away from each other, causing the jacks 328 to collapse downward. Two aligned bores 316, 318 are positioned within the bottom plate 312 and top plate 314, respectively, which allow discharge from the toilet to pass through the lift 310 by way of a drain extension (not shown). Preferably, the top plate 314 includes a lowered channel 330 for receiving a toilet and providing added stability. An external power source (not shown) can be employed to rotate the screw 322. In the alternative, the knob 332 can be turned manually.

Figure 18:
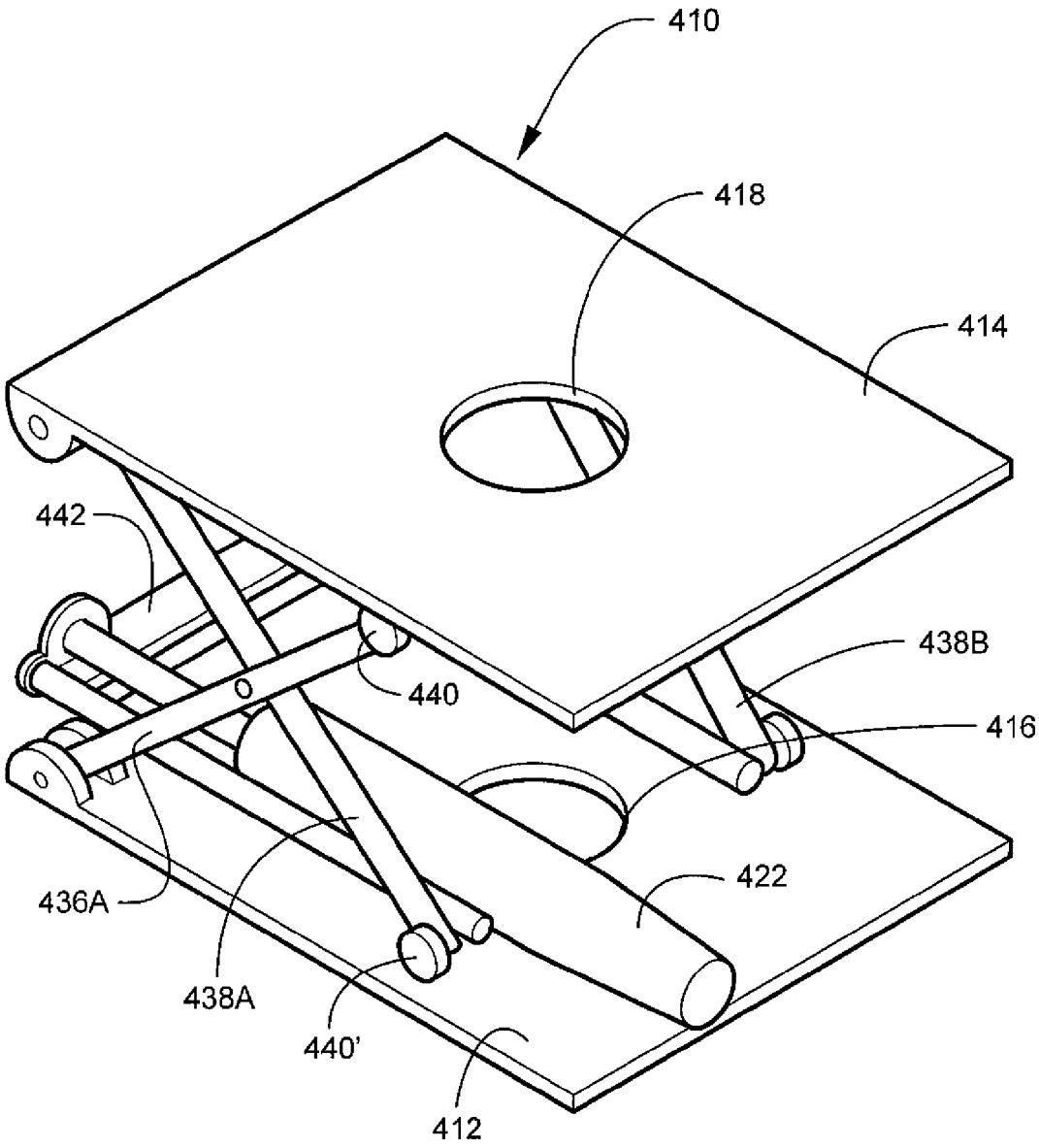
FIG. 18 is a perspective view of another adjustable toilet lift.

FIG. 18 shows an alternative lift 410 in which an X-frame, located between a base plate 412 and a top plate 414, comprises a first pair of rods 436A, 438A and a second pair of rods 436B, 438B. The pairs are identical and only 436A and 438A are described in detail. The rods 436A, 438A are arranged in a crisscross fashion and pivotally connected by a pin 439. One end of rod 436A is pivotally connected to the base plate 412, while the other end, which carries a rolling wheel 440, contacts the underside of the top plate 414. One end of rod 438A is pivotally connected to the underside of the top plate 414, while the other end, which carries a rolling wheel 440', contacts the bottom plate 412. An adjusting frame 442 is connected to rod 438A in close proximity to the rolling wheel 440'. The adjusting frame 442 comprises a rod arrangement that is connected to and driven by an actuator, such as the illustrated gas spring 422.

Movement of the gas spring 422 moves the adjusting frame 442, which in turn drives the rolling wheel 440 in a horizontal direction to move the top plate 414 relative to the bottom plate 412. Two centrally located bores 416, 418 are positioned within the bottom plate 412 and top plate 414, respectively, which allow discharge from the toilet to pass through the lift 410 by way of a drain extension (not shown).

Figure 19:
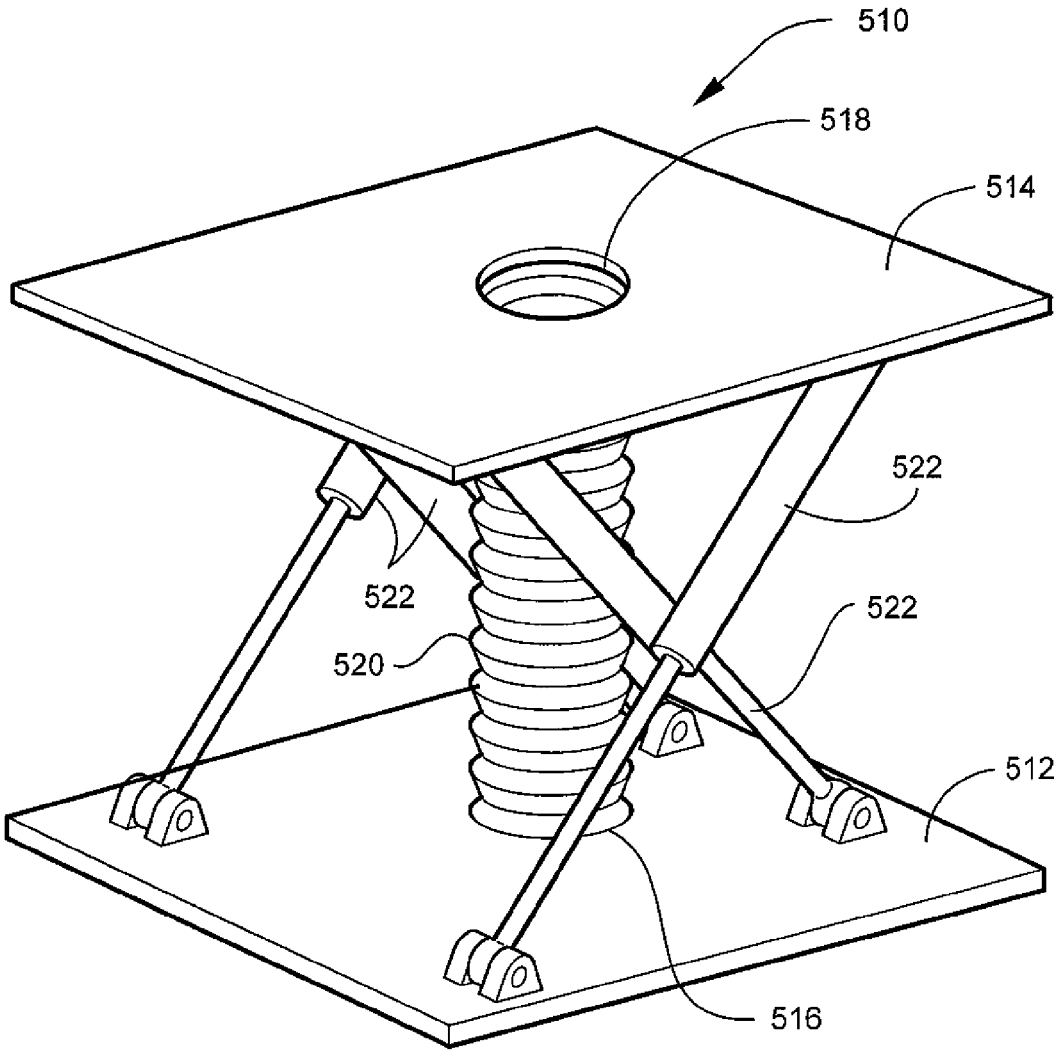
FIG. 19 is a perspective view of another adjustable toilet lift.

FIG. 19 shows an alternative lift 510 that employs a plurality of actuators 522 which are pivotally connected to both the bottom plate 512 and top plate 514. The actuators 522 are arranged in a crisscross arrangement. Extension or retraction of the actuators 522 raises or lowers the top plate 514 respectively, while the crisscross configuration provides stability to the top plate 514. The actuators 522 may be any device capable of raising the top plate 514 under a load, such as screw jacks, pneumatic jacks, or spring lifts. In the illustrated example, the actuators 522 are gas springs. A flexible, extendible drain extension 520 extends between bores 516, 518 located in the base plate 512 and top plate 514, respectively.

Figure 20:
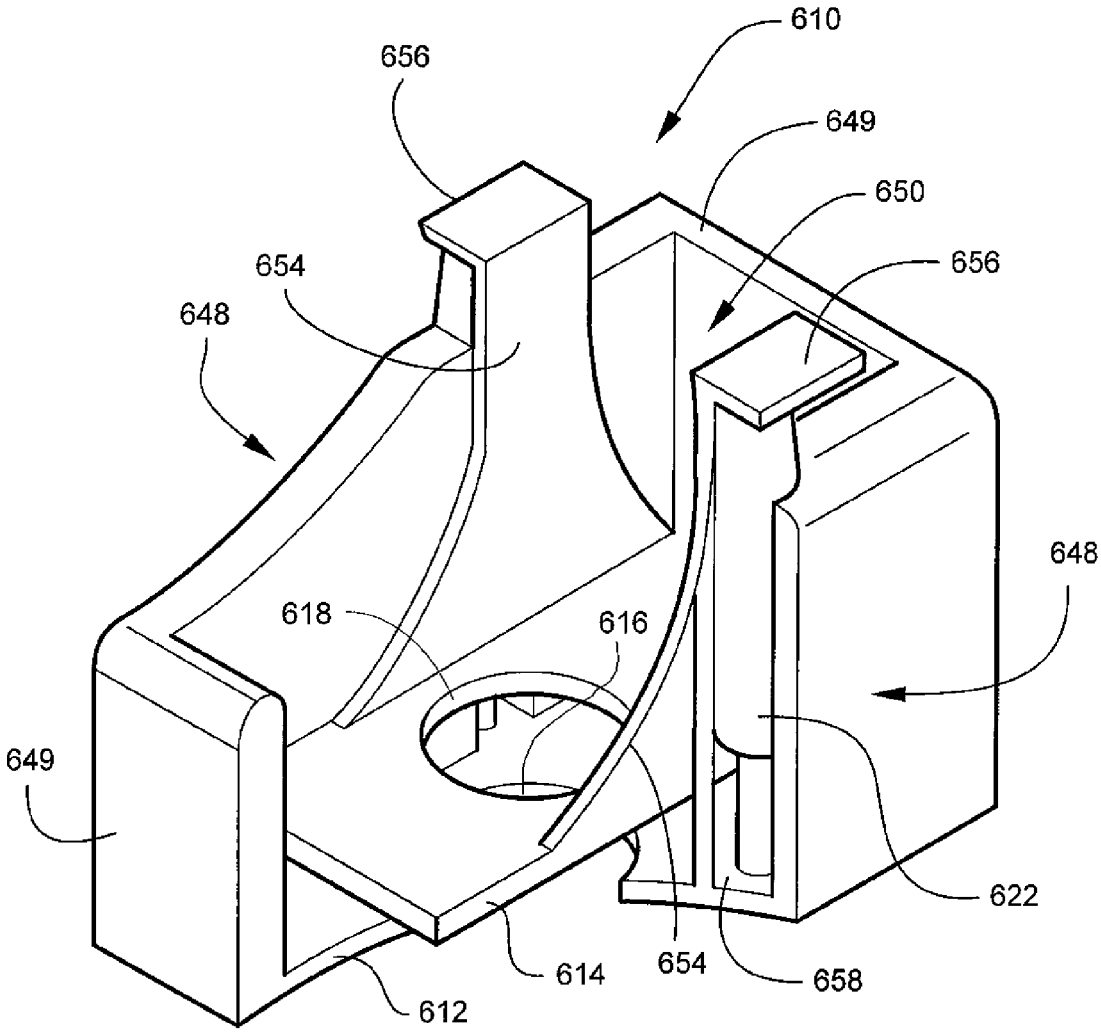
FIG. 20 is a partially-sectioned, perspective view of yet another alternative adjustable toilet lift.

FIG. 20 shows an alternative lift 610 comprising a base plate 612 having spaced-apart side portions 648 and spaced apart end walls 649, which extend upwardly to collectively form a cavity 650 therein. An open-ended chamber 658 is located within each of the walls 648 and houses an actuator for adjusting a top plate 614 relative to the bottom plate 612, which is a gas spring 622 in the illustrated example. A top plate 614 defines two upwardly extending side members 654, including outwardly extending flange members 656 at the upper ends thereof. The side members 656 are connected to the distal ends of the gas springs 622 which protrude through the open end of the chambers 658. Two centrally located bores 616, 618 are positioned within the bottom plate 612 and top plate 614, respectively, to allow discharge from a toilet to pass through the lift 610 by way of a drain extension (not shown). The cavity 650 of this embodiment provides the added benefit of increased support to the base of the toilet, which prevents bending moments. In addition, the side portions 648 provide a decorative touch that is more aesthetically pleasing to a consumer and protect the gas springs 622.

The lifts as described herein allow an individual to preset the required height of the toilet before use. After the user is seated upon the seat of the toilet, the height can be further adjusted to accommodate the requirements and desires of the user. After use, the height can be adjusted again to allow the user to safely remove themselves from the seat. The adjustment of the height can be accomplished by way of an external power source before, during, and after use.

The lifts illustrated in FIGS. 16-20 can be integral to a toilet or separately installed on an existing toilet. During installation, the base plate of the toilet lift is secured to a common household drain using a wax seal of a known type, and securely connected to the floor using screws, fasteners, or the like. For integral units, the top plate would be integrally formed with the base portion of a toilet. For units which are attached to an existing toilet, the top plate is welded, glued, fastened, anchored, bolted, or screwed to the bottom of the toilet, with the drain outlet of the toilet placed over the bore of the top plate and connected to the drain extension. A wax seal may be installed between the top plate and the bottom of the toilet in this application to ensure no leakage occurs.

In the case where the lift uses an actuator requiring an external power source, this may be an electric, air, or hydraulic motor connected to the actuator, which is activated by a foot pedal, wall mounted joy stick, or other similar control mechanism. The user is able to operate the external power source using the control to adjust the toilet to the desired height.

A lift can also be controlled remotely by a motion sensor disposed near a toilet and interconnected to a centrally located server, which is in turn connected to an external power source. The centrally located server includes a preset initial height stored therein. When the motion sensor is activated by an individual approaching the toilet, the server automatically activates the external power source to adjust the toilet to the preset initial height.

An adjustable toilet and a lift for a toilet are described above. Various details of the invention may be changed without departing from its scope. Furthermore, the foregoing description of the preferred embodiments of the invention and the best mode for practicing the invention are provided for the purpose of illustration only and not for the purpose of limitation.

What is claimed is:

1. An adjustable height toilet, comprising:

(a) a toilet base plate for being attached to a floor, the base plate having a first end portion, a second end portion, and a hole disposed on the base plate in between the first and second end portions of the base plate;

(b) a toilet housing carried by the base plate and movable up and down relative thereto, the toilet housing including:

(i) a tank housing including a water tank;

(ii) a toilet bowl; and (iii) a flushing mechanism;

(c) at least a first and second fluid lifting cylinders, wherein each lifting cylinder has a lower end, the lower end of the first fluid lifting cylinder being attached to the first end portion of the base plate and the lower end of the second fluid lifting cylinder being attached to the second end portion of the base plate such that the base plate hole is disposed in between the lower end of the first fluid lifting cylinder and the lower end of the second fluid lifting cylinder, the at least first and second fluid lifting cylinders being disposed between the base plate and the toilet housing, the lifting mechanism operable to move the toilet housing from a lowered position adjacent to the base plate to a raised position spaced-away from the base plate;

(d) a lift valve operable to selectively connect the at least first and second fluid lifting cylinders to:

(i) a supply of pressurized fluid, so as to raise the toilet housing; or (ii) a drain path to allow the fluid to drain from the at least first and second fluid lifting cylinders, so as to lower the toilet housing, wherein the operation of the lift valve is configured to cause the fluid from the at least first and second lifting cylinders to discharge into the water tank, where the water tank is at least partially empty, in a manner that conserves the fluid for flushing of the toilet in a subsequent flush;

(e) a drainage pipe assembly connected to the toilet housing, the drainage pipe assembly arranged to allow discharge from the toilet bowl to pass from the toilet housing toward the hole disposed on the base plate regardless of the position of the toilet housing;

(f) a lid mounted to the toilet bowl and movable between open and closed positions;

(g) a drain valve connecting the at least first and second fluid lifting cylinders to the drain path to allow the fluid to drain from the at least first and second fluid lifting cylinders; and (h) a linkage operably connected to the lid such that:

(i) the flushing mechanism is automatically activated to flush the toilet when the lid is moved to the closed position via a mechanical connection with the linkage, and (ii) the drain valve is automatically activated when the lid is moved to the closed position via a mechanical connection with the linkage, the drain valve allows the fluid to drain from the at least first and second fluid lifting cylinders, so as to lower the toilet housing.

2. The adjustable height toilet of claim 1 where the at least first and second fluid lifting cylinders are integrally-formed with the toilet housing.

3. The adjustable height toilet of claim 1 where the toilet housing is received between a pair of opposed side panels extending upward from the toilet base plate.

4. The adjustable height toilet of claim 1 where the drainage pipe assembly includes a plurality of concentric pipe segments, the diameter of the segments decreasing from a bottom to a top of the drainage pipe assembly, each pipe segment including an outwardly-extending flange at its lower end and a resilient ring at its upper end such that lowering and raising of the toilet will have a scrubbing action on the sidewalls of the drainage pipe assembly and drop scrubbed off liquid and solid particles down the base plate hole.

5. The adjustable height toilet of claim 1 further including: left and right side rails mounted to the toilet housing, the side rails individually movable between a lowered use position and a raised position.

6. The adjustable height toilet of claim 5 wherein the lateral position of each side rails is adjustable so as to vary the width between the side rails.

7. The adjustable height toilet of claim 1 wherein a preselected volume of water required to raise the toilet housing from the lower position to the raised position is substantially equal to a preselected volume of water stored in the water tank to flush the bowl.

8. The adjustable height toilet of claim 1 further including an adjustable stop carried by the toilet housing for preventing motion of the toilet bowl below a preselected lower limit.

9. The adjustable height toilet of claim 1 further including an adjustable stop carried by the toilet housing for preventing motion of the toilet bowl above a preselected upper limit.

10. The adjustable height toilet of claim 1, wherein each fluid lifting cylinder comprises:

(a) a rigid first portion;

(b) a rigid second portion, wherein the second portion slides within the first portion to form a piston mechanism;

(c) a cylinder supply line connected to the lift valve configured to allow pressurized fluid to flow into the piston mechanism, where the pressurized fluid forces at least one of the first and second portion upward, so as to raise the toilet housing; and (d) a recycling line connected to the lift value configured to allow pressurized fluid to exit the piston mechanism as the gravitational force of the toilet housing forces at least one of the first and second portion downward causing the pressurized liquid to drain out of the piston mechanism, so as to lower the toilet housing.

11. The adjustable height toilet of claim 10, wherein the second portion is connected to the base plate.

12. The adjustable height toilet of claim 1, wherein at least a portion of the linkage is mounted on an outer surface of the toilet tank and the linkage comprises:

a lift valve that is connected to (i) a valve supply pipe and (ii) an actuating rod;

a length of the actuating rod being substantially parallel to (i) a length of the at least first and second fluid cylinders and (ii) a length of the drainage pipe assembly, wherein the actuating rod has an end portion that is connected to a pivot plate;

the pivot plate being mounted on the tank housing and pivotably connected to a height adjustment lever, wherein the height adjustment lever is configured to move up and down in the same direction that the toilet bowl of the adjustable toilet is raised and lowered.

13. The adjustable height toilet of claim 1, wherein no electricity is required for the linkage to automatically (i) activate the flushing mechanism to flush the toilet and (ii) activate the drain valve allowing the fluid to drain from the at least first and second fluid lifting cylinders, so as to lower the toilet housing.

14. A method for conserving pressurized fluid in an adjustable height toilet, the method comprising:

providing a pressurized fluid to the adjustable toilet according to claim 8 so as to raise the adjustable height toilet;

draining the pressurized fluid so as to lower the adjustable height toilet; and discharging the pressurized fluid into a toilet tank, so as to conserve the pressurized fluid in the toilet tank for a subsequent flush.

* * * * *